US009746243B2

(12) United States Patent
Devroe et al.

(10) Patent No.: US 9,746,243 B2
(45) Date of Patent: Aug. 29, 2017

(54) DEVICE FOR COOLING THE OPENING OF A ROTARY KILN BY MEANS OF COOL AIR-BLOWING

(75) Inventors: Sebastien Devroe, Villeneuve d'Ascq (FR); Damien Fontaine, Villenueve d'Ascq (FR)

(73) Assignee: FIVES FCB, Villeneuve d'Ascq (FR)

( * ) Notice: Subject to any disclaimer, the term of this patent is extended or adjusted under 35 U.S.C. 154(b) by 496 days.

(21) Appl. No.: 14/367,676

(22) PCT Filed: Dec. 23, 2011

(86) PCT No.: PCT/FR2011/000678

§ 371 (c)(1),
(2), (4) Date: Jul. 3, 2014

(87) PCT Pub. No.: WO2013/093212

PCT Pub. Date: Jun. 27, 2013

(65) Prior Publication Data

US 2014/0377713 A1 Dec. 25, 2014

(51) Int. Cl.

| | |
|---|---|
| ***F27B 7/38*** | (2006.01) |
| ***F27B 7/22*** | (2006.01) |
| ***F27B 7/40*** | (2006.01) |

(52) U.S. Cl.

CPC ..... *F27B 7/383* (2013.01); *F27B 7/224* (2013.01); *F27B 7/386* (2013.01); *F27B 7/40* (2013.01)

(58) Field of Classification Search

CPC ..... F27B 7/38; F27B 7/383
See application file for complete search history.

(56) References Cited

U.S. PATENT DOCUMENTS

| | | | |
|---|---|---|---|
| 4,295,825 | A | 10/1981 | Chielens et al. |
| 4,370,128 | A | 1/1983 | Chielens et al. |

(Continued)

FOREIGN PATENT DOCUMENTS

| | | |
|---|---|---|
| EP | 00 12660 | 6/1980 |
| EP | 0 053 049 | 6/1982 |

(Continued)

OTHER PUBLICATIONS

International Search Report dated Sep. 27, 2012, corresponding to PCT/FR2011/000678.

*Primary Examiner* — Alissa Tompkins
*Assistant Examiner* — John Bargero
(74) *Attorney, Agent, or Firm* — Young & Thompson

(57) ABSTRACT

A device for cooling the opening of a rotary kiln via cool air-blowing, the kiln including a metal cylinder lined internally with a refractory material and being rotatably mounted relative to the frame of the kiln, into which materials are intended to be inserted and fired. The cooling device includes: the aforementioned cylinder and a metal cylinder end part covered with a refractory material and secured to the cylinder; two concentric metal casings, known as the inner and outer casing, which surround the cylinder of the kiln and form two annular channels; and ventilation elements that allow cool air to flow through the annular channels. The device includes: an annular distribution chamber which surrounds the cylinder, is secured thereto and supplies the first channel with air; ventilation elements including at least one fan and an electric motor actuating the fan, and supplying the distribution chamber in an air-tight manner.

13 Claims, 3 Drawing Sheets

(56) References Cited

U.S. PATENT DOCUMENTS

| | | | | | |
|---|---|---|---|---|---|
| 4,376,280 | A | * | 3/1983 | Davis | G01K 13/08<br>340/870.17 |
| 4,707,175 | A | | 11/1987 | Heithoff et al. | |
| 4,836,775 | A | * | 6/1989 | Heithoff | C03B 5/44<br>432/103 |

FOREIGN PATENT DOCUMENTS

| | | |
|---|---|---|
| EP | 0 228 650 | 7/1987 |
| EP | 1 580 509 | 9/2005 |
| FR | 2 159 118 | 6/1973 |
| FR | 2 410 802 | 6/1979 |
| FR | 2 443 654 | 7/1980 |
| FR | 2 494 827 | 5/1982 |

* cited by examiner

DEVICE FOR COOLING THE OPENING OF A ROTARY KILN BY MEANS OF COOL AIR-BLOWING

The invention relates to a device for cooling the opening of a rotary kiln by means of cool air-blowing.

The field of the invention is that of rotary kilns, in particular kilns used in the calcination of mineral materials, such as for example in the manufacture of cement clinker.

A rotary kiln is constituted substantially of a metal cylinder, usually referred to as shell, of which the inner wall is protected by a refractory material such as brick or concrete. Materials are introduced into the cylinder of the kiln inside of which they are intended to be fired. During the firing, the cylinder of the kiln is driven in rotation on its axis.

The major portion of the metal cylinder of the kiln is located in the open air. However, each of the ends of the metal cylinder penetrates into a fixed case wherein hot gases flow, as such providing the continuity of the treatment circuit between the rotary kiln and the fixed portions of the installation of which the kiln is a part.

The output end of the hot materials conventionally comprises a burner and is most often the hottest portion of the cylinder of the kiln. At this end, the cylinder of the kiln is as such subjected to strong thermal stresses and it is necessary to cool it in order to provide for its protection. This end of the metal cylinder is moreover protected by a system for protection that comprises one or several metal end parts, secured to the end of the cylinder, covered with a refractory lining.

The cooling is generally carried out by means of cool air-blowing, and it is known to channel air along the wall of the cylinder of the kiln by constructing several casings around the cylinder. (FR-2.443.654 and FR-2.494.827).

In known devices for cooling, the fans that supply the air required for the cooling are fixed relative to the frame.

According to a first prior art, these fans blow facing one of the annular channels, directly or by the intermediary of a distribution duct. Only a portion of the air penetrates into the channel, with the rest escaping into the ambient atmosphere. The cooling is uncertain, unless an overly high ventilation capacity is available.

According to a second prior art, a rotary seal has a fixed crown surrounding the cylinder, provided with a sliding system on the surface of the cylinder and provides the air-tight seal between the fans and one of the annular channels. In this case, losses of air are prevented, but the sealing system is subjected to high wear, requiring regular maintenance.

The purpose of this invention is to overcome the aforementioned disadvantages by proposing a device for cooling the opening of a rotary kiln by means of cool air-blowing, with easy maintenance and improved cooling performance.

Other purpose of this invention is to propose a device for cooling with increased safety in the case a fan is stopped.

Other purposes and advantages of this invention shall appear when reading the following description which is provided solely for the purposes of information and which does not have for purpose to limit it.

As such the invention relates to a device for cooling the opening of a rotary kiln by means of cool air-blowing, said kiln comprising a metal cylinder lined internally with a refractory material, said cylinder being rotatably mounted relative to the frame of the kiln, into which materials are intended to be inserted and fired, said device for cooling comprising:

said cylinder of said rotary kiln and a metal cylinder end part, covered with a refractory material, secured to said cylinder, intended to protect the end of the cylinder of the kiln from high temperatures, two concentric metal casings, known as the inner casing and outer casing, said two casings surrounding said cylinder of the kiln and constituting two annular channels between on the one hand, said cylinder and said inner casing, known as the first channel, and on the other hand, between said inner casing and said outer casing, known as the second channel, ventilation means that allow cool air to flow through said annular channels, in such a way as to allow for the flow of air in said first channel to the end part, then the flow of air in the opposite direction in said second channel, before the escaping of the air through an exhaust opening of said second channel.

According to the invention, said device for cooling comprises:

an annular distribution chamber, surrounding said cylinder and secured to said cylinder of the kiln, supplying said first channel with air, said ventilation means comprising at least one fan and an electric motor actuating said at least one fan, said ventilation means being borne on the metal cylinder of the kiln, rotatably mounted therewith, supplying said distribution chamber in an air-tight manner, rotating electrical connectors, comprising annular rings surrounding said cylinder of the kiln, and contacts, able to slide or roll on the annular rings during the rotation of the kiln in order to allow electricity to be supplied to the electric motor(s) of said ventilation means.

According to optional characteristics of the invention, taken individually or as a combination:

the annular rings are placed on the distribution chamber, arranged on the most outer wall of said distribution chamber relative to the cylinder of the kiln;

the distribution chamber comprises venting orifices on said most outer wall of the distribution chamber relative to the cylinder of the kiln in such a way as to allow to escape a minor fraction of the air blown by said ventilation means, representing in particular between 2% and 20% of the air blown by said ventilation means;

an annular screen is arranged between said exhaust opening of the second channel and said rotating electrical connectors;

the annular rings are rigidly secured to the cylinder of the kiln, and the rotating or sliding contacts are secured to the frame, with the contacts being free in translation along an axis parallel to the axis of the cylinder by the intermediary of means for guiding in translation between said contacts and the frame of the kiln in such a way as to follow the displacement of the annular rings during the expansion/contraction of the cylinder of the kiln;

the cool air drawn by said at least one fan flows in a casing surrounding the electric motor of said fan before it enters the fan;

the device comprises several fans supplying, in parallel, said distribution chamber with cool air by the intermediary of independent circuits respectively joining each of the fans to said distribution chamber, with an automatic closing valve associated to each of said fans, able to close said corresponding circuit joining said fan and said distribution chamber in the case where said fan is stopped.

The invention shall be better understood when reading the following description along with the annexed drawings among which:

Figure 1:
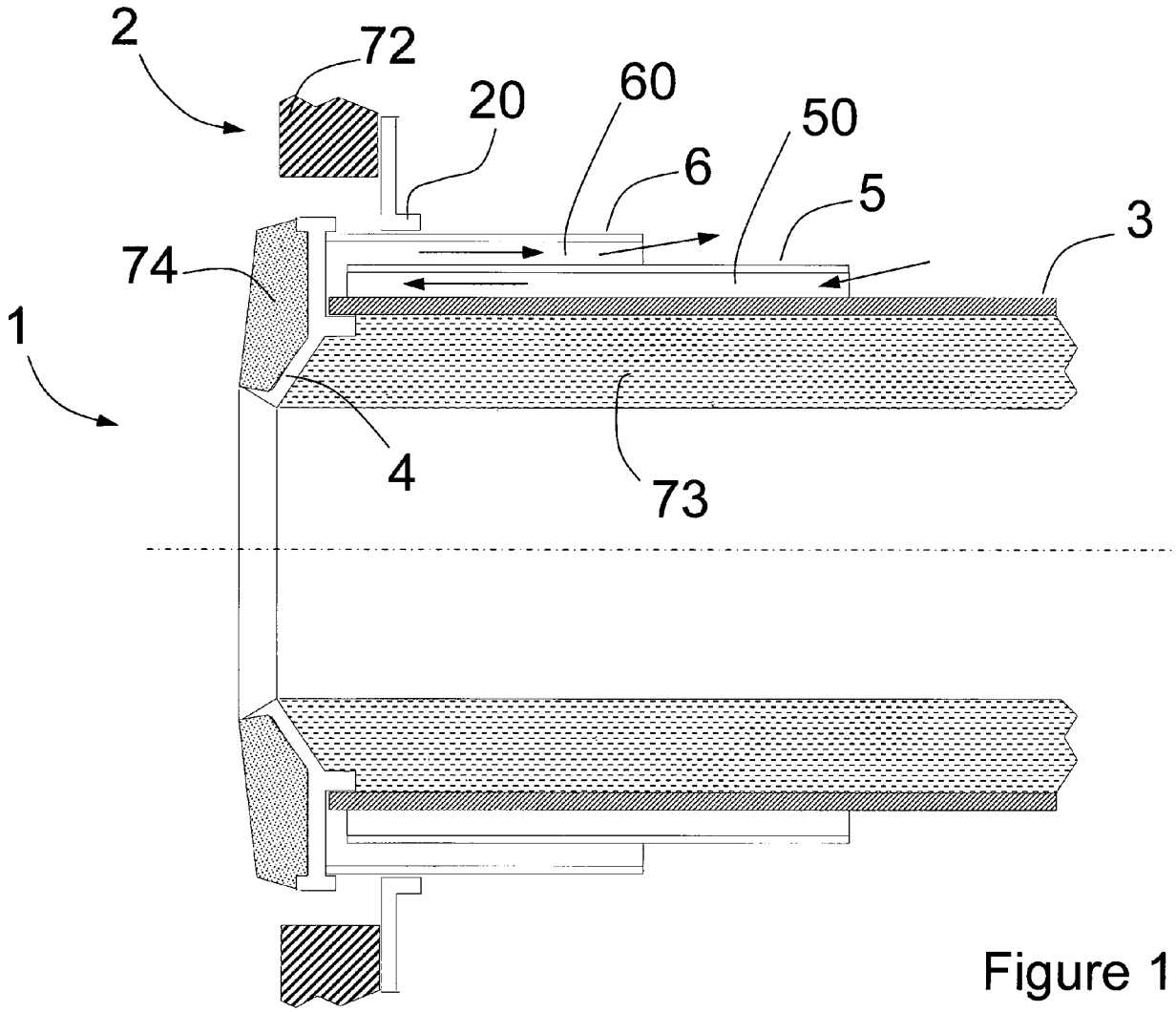
FIG. 1 is a diagrammatical view, as a partial cross-section, of a device for cooling in accordance with the invention.
Figure 2:
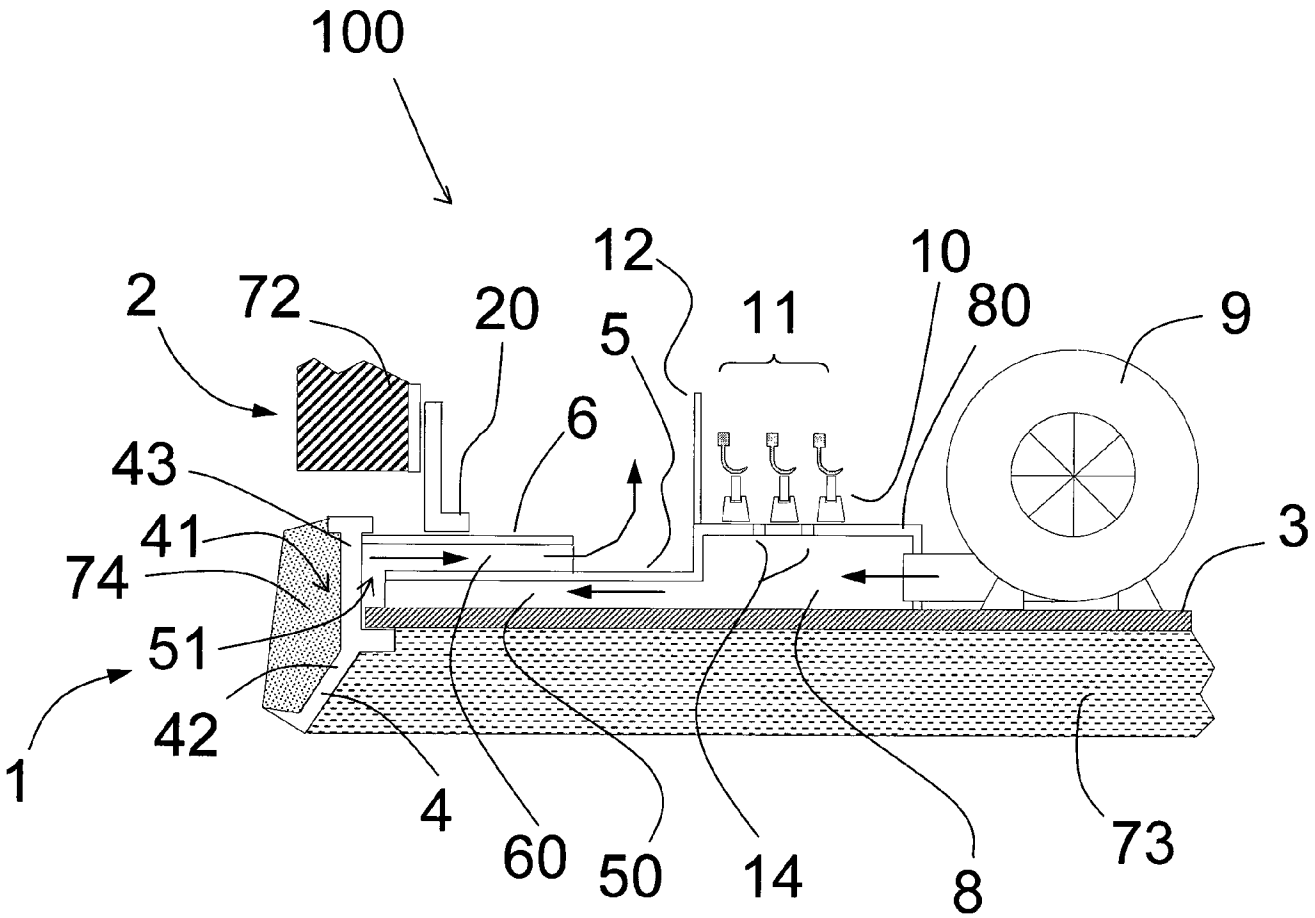
FIG. 2 is a view of the device for cooling according to FIG. 1, with in addition the distribution chamber and ventilation means.

As such, the invention relates to a device 100 for cooling the opening of a rotary kiln 1 by means of cool air-blowing.

The kiln comprises a metal cylinder 3 lined internally with a refractory material 73, said cylinder 3 is rotatably mounted relative to the frame of the kiln.

Materials, in particular minerals, are intended to be introduced into the cylinder 3 and are intended to be fired inside the cylinder 3.

This can in particular be a rotary kiln of an installation for the calcination of mineral materials, for example used in the production of clinker in cement works.

The major portion of the cylinder 3 of the kiln is in the open air. However, each of the ends of the metal cylinder 3 penetrates into a fixed case wherein hot gases flow, as such providing the continuity of the treatment circuit between the rotary kiln and the fixed portions of the installation of which the kiln is a part.

The output end of the hot materials conventionally comprises a burner and is most often the hottest portion of the cylinder of the kiln. At this end, the cylinder of the kiln is as such subjected to strong thermal stresses and it is necessary to cool it in order to provide for its protection. This end penetrates into a fixed case 2, usually referred to as a kiln hood. A sealing device 20 provides the closing of the circuit of the installation between the fixed case 2 and the mobile cylinder 3, of the rotary kiln, by cooperating in particular with an outer casing 6 that shall be described in what follows. This end of the metal cylinder is moreover protected by a device for protecting that comprises one or several end parts 4 of the metal cylinder, secured to the end of the cylinder, covered with a refractory material 74, such as brick or concrete.

The end part or parts 4 are arranged inside the fixed case 2.

By simplification is the rest of the application, this will be mentioned as the end part 4. In practice, this end part 4 can be in reality constituted of several metal end parts distributed over the periphery of the cylinder 3, and secured to one of the ends of said cylinder.

The metal end part 4, can have an outer wall 41, in particular concave, facilitating the lining and the attaching of the refractory material 74, a wing 43 extending towards the exterior of the cylinder 3 of the kiln, and a wing 42 extending towards the axis of the cylinder 3, in particular covering the edge of the refractory material 73 arranged on the inner wall of the cylinder 3.

Said device 100 for cooling comprises:

- said cylinder 3 of said rotary kiln and the end part 4 of the metal cylinder, covered with the refractory material 74, secured to said cylinder 3, intended to protect the end of the cylinder 3 of the kiln from high temperatures,
- two concentric metal casings 5, 6, known as the inner casing 5 and outer casing 6, said two cylindrical casings 5, 6, surrounding said cylinder 3 of the kiln 1 and constituting two annular channels 50, 60 between on the one hand, said cylinder 3 and said inner casing 5, known as the first channel 50, and on the other hand, between said inner casing 5 and said outer casing 6, known as the second channel 60,
- ventilation means that allow cool air to flow through said annular channels 50, 60.

In such a device, the flow of air is carried out in said first channel 50 to the end part 4, then in the opposite direction in said second channel 60, before escaping of the air by an exhaust opening of said second channel 60.

The air is as such blown from the exterior of the fixed case 2 in the first channel 50. In the first channel 50, the air sweeps the cylinder 3, then sweeps the end part 4, in particular the wing 43, cooling the cylinder 3 and said end part 4. Then, the air flows in the opposite direction in the second channel 60 from the interior of the fixed case 2, towards the exterior where it escapes via an exhaust opening of the second channel 60.

Note that the inner casing 5 is arranged at a distance in relation to the end part 4 in such a way as to create an annular passage 51 between the first channel 50 and the second channel 60. This passage 51 is defined between the end part 4, the inner casing 5 and the outer casing 6. On the contrary, the outer casing 6 is in air-tight contact with the wing 43 of the end part 4.

According to the invention, said device for cooling comprises:

- an annular distribution chamber 8, surrounding said cylinder 3 and secured to said cylinder 3 of the kiln, supplying said first channel 50 with air,
- said ventilation means comprising at least one fan 9 and an electric motor actuating said at least one fan 9, said ventilation means being borne on the metal cylinder 3 of the kiln, rotatably mounted therewith, supplying the distribution chamber 8 in an air-tight manner,
- rotating electrical connectors 10, 11, comprising annular rings 10 surrounding said cylinder 3 of the kiln, and contacts 11, able to slide or roll on the annular rings 10 during the rotation of the kiln in order to allow electricity to be supplied to the electric motor(s) of said ventilation means.

Advantageously, the fan or fans 9 of the ventilation means are secured to the cylinder 3 of the rotary kiln, making it possible to supply the first channel 50 with blown air by preventing, or even substantially limiting the losses of air, and without using a rotary seal such as is known in prior art.

The supply with blown air by the ventilation means is carried out by the intermediary of a distribution chamber 8 of which the function is to evenly distribute the flow of blown air over the entire annular section of the first channel 50. The section of the distribution chamber is as such sized for this purpose.

The fan or fans 9 are driven by one or several electric motors, of which the supply of electricity is provided by the intermediary of rotating electrical connectors 10, 11. The annular rings 10 are rigidly secured to the cylinder 3 of the kiln 1, and the rotating or sliding contacts 11, are secured to the fixed frame.

The number of annular rings 10 (and therefore of contacts 11) depends on the electrical connection method of the motors. The number of rings will be, for example, at least three (i.e. three) for motors operating with three-phase current and two for motors operating with single-phase alternating current or with direct current.

Possibly, an additional annular ring (and an associated contact) can be added for an additional signal intended for controlling the electric motor(s) 9.

The annular distribution chamber 8, can be carried out between the outer wall of the cylinder 3 and an annular hooding 80, extending the inner casing 5.

The metal cylinder 3 of the kiln, protected by the internal refractory material 73, can reach several hundreds of degrees Celsius, even in its portion located in the open air.

In order to protect the electrical conductors 10, 11 from high temperatures, the annular rings 10 can be placed on the distribution chamber 8, which is maintained at a low temperature thanks to the air that flows therein, on the most outer wall of said distribution chamber 8 relative to the cylinder 3 of the kiln 1. This distribution chamber 8 can be of rectangular section.

With the same concern for cooling electrical conductors, the distribution chamber 8 can comprise venting orifices 14 on said most outer wall of the distribution chamber relative to the cylinder of the kiln 1 in such a way as to allow a minor fraction of the air blown by said ventilation means to escape.

This minor fraction can represent between 2% and 20% of the air blown by said ventilation means and make it possible to provide the cooling of the annular rings 10.

The electrical conductors 10, 11 can be protected from the hot air flow escaping from the second channel 60 thanks to an annular screen 12 arranged between said exhaust opening of the second channel 60 and said rotating electrical connectors 10, 11.

Each motor of fan 9 can also be protected from high temperatures by circulating the cool air drawn by the fan 9 in a casing surrounding the electric motor of said fan 9, before it enters said fan 9.

As the cylinder 3 of the kiln is subjected to expansion/contraction due to the variations in its temperature, the position of the annular rings 10 along the axis of the cylinder 3 is not unique in relation to a fixed bearing.

Advantageously and in order to overcome this disadvantage, the contacts 11 can be free in translation along an axis parallel to the axis of the cylinder 3 by the intermediary of means for guiding in translation between said contacts 11 and the frame of the kiln in such a way as to follow the displacement of the annular rings 10 during the expansion/contraction of the cylinder of the kiln.

In order to overcome any failure of a fan, the ventilation means can include several fans 9 supplying, in parallel, said distribution chamber 8 with cool air by the intermediary of independent circuits joining respectively each of the fans 9 to said distribution chamber 8.

Figure 3:
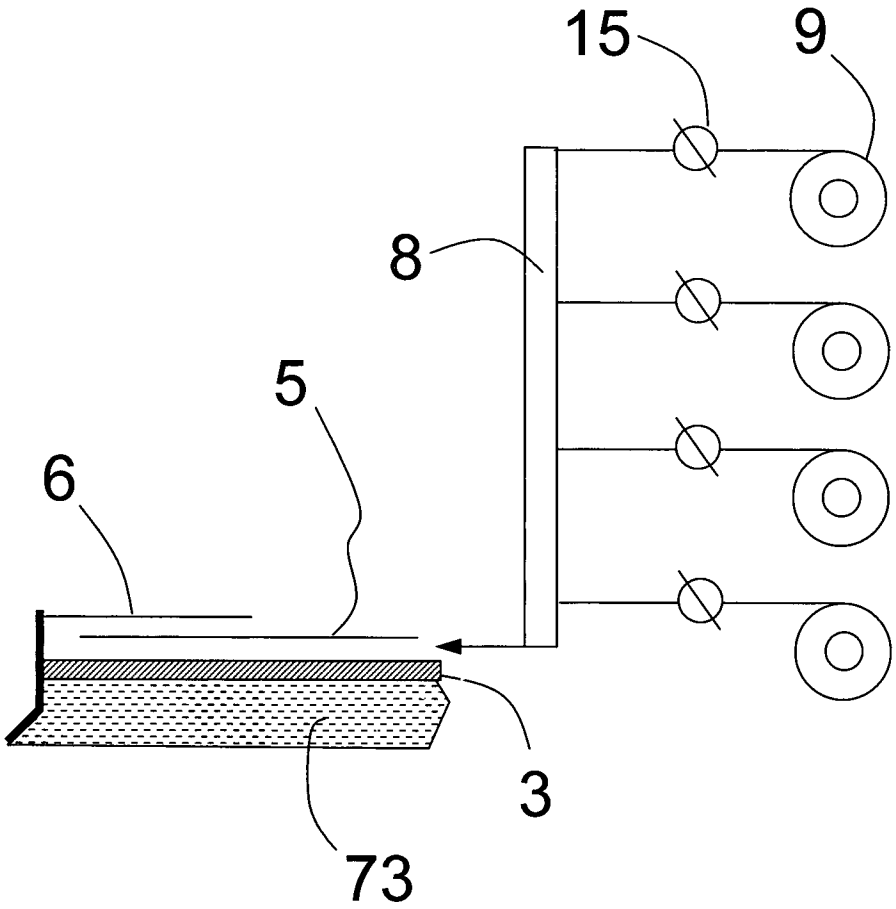
FIG. 3 is a diagrammatical view of a device for cooling in accordance with the invention, according to an embodiment, comprising several fans.

Advantageously, in order to prevent the escaping of the cool air via the stopped fan, a valve 15 with automatic closure can be associated with each of said fans 9, able to close said corresponding circuit joining said fan 9 and said distribution chamber 8 in the case of the stoppage of said fan (FIG. 3).

Naturally other embodiments could have been considered without however leaving the scope of the invention such as defined by the claims hereinafter.

NOMENCLATURE

1 Rotary kiln,
2 Fixed case,
3 Cylinder,
4 End part,
5 Inner casing,
6 Outer casing,
8 Distribution chamber,
9 Fan,
10 Annular rings (Electrical connectors),
11 Contacts (Electrical connectors),
14 Venting orifices (Distribution chamber 8),
15 Valve,
41 Outer wall (End part 4),
42 Wing (End part 4),
43 Wing (End part 4),
50 First channel,
51 Annular passage,
60 Second channel,
72 Refractory material (Fixed case 2),
73 Refractory material (Cylinder 3),
74 Refractory material (End part 4),
80 Hooding (Distribution chamber 8),
100 Device for cooling.

The invention claimed is:

1. A device (100) for cooling the opening of a rotary kiln (1) by means of cool air-blowing, said kiln comprising a metal cylinder (3) lined internally with a refractory material (73), said cylinder (3) being rotatably mounted relative to the frame of the kiln, into which materials are intended to be inserted and fired, said device (100) for cooling comprising:

said cylinder (3) of said rotary kiln and an end part (4) of the metal cylinder, covered with a refractory material (74), secured to said cylinder (3), intended to protect the end of the cylinder (3) of the kiln from high temperatures, two concentric metal casings (5, 6), known as the inner casing (5) and outer casing (6), said two casings (5, 6) surrounding said cylinder (3) of the kiln (1) and constituting two annular channels (50, 60) between on the one hand, said cylinder (3) and said inner casing (5), known as the first channel (50), and on the other hand, between said inner casing (5) and said outer casing (6), known as the second channel (60), ventilation means that allow cool air to flow through said annular channels (50, 60), in such a way as to allow the flow of air in said first channel (50) to the end part (4), then the flow of air in the opposite direction in said second channel (60), before the escaping of the air via an exhaust opening of said second channel (60), an annular distribution chamber (8), surrounding said cylinder (3) and secured to said cylinder (3) of the kiln, supplying said first channel (50) with air, said ventilation means comprising at least one fan (9) and an electric motor actuating said at least one fan (9), said ventilation means being borne on the metal cylinder (3) of the kiln, rotatably mounted therewith, supplying said distribution chamber (8) in an air-tight manner, rotating electrical connectors (10, 11), comprising annular rings (10) surrounding said cylinder (3) of the kiln, and contacts (11), able to slide or roll on the annular rings (10) during the rotation of the kiln in order to allow electricity to be supplied to the electric motor(s) of said ventilation means, and wherein, the annular rings (10) are placed on the distribution chamber (8), on the most outer wall of said distribution chamber (8) relative to the cylinder (3) of the kiln, an annular screen (12) is arranged between said exhaust opening of the second channel (60) and said rotating electrical connectors (10, 11), and the cool air drawn by said at least one fan (9) flows in a casing surrounding the electric motor of said fan (9) before it enters said fan (9).

2. The device according to claim 1, wherein the distribution chamber (8) comprises venting orifices (14) on said most outer wall of the distribution chamber relative to the cylinder of the kiln (1) configured in such a way as to allow a minor fraction of the air blown by said ventilation means to escape.

3. The device according to claim 2, wherein the venting orifices are configured so that said minor fraction escaping through the venting orifices represents between 2% and 20% of the air blown by said ventilation.

4. The device according to claim 1, wherein the annular rings (10) are rigidly secured to the cylinder of the kiln (1), and the rotating or sliding contacts (11), are secured to the frame, with the contacts (11) being free in translation along an axis parallel to the axis of the cylinder (3) by the intermediary of means for guiding in translation between said contacts (11) and the frame of the kiln in such a way as to follow the displacement of the annular rings (10) during the expansion/contraction of the cylinder of the kiln.

5. The device according to claim 1, wherein the ventilation means include several fans (9) supplying, in parallel, said distribution chamber (8) with cool air by the intermediary of independent circuits joining respectively each of the fans (9) to said distribution chamber (8), a valve (15) with automatic closure being associated with each of said fans (9), able to close said corresponding circuit joining said fan (9) and said distribution chamber (8) in the case of a stoppage of said fan.

6. A rotary kiln (1) provided with the device for cooling according to claim 1.

7. The device according to claim 1, wherein the annular rings (10) are rigidly secured to the cylinder of the kiln (1), and the rotating or sliding contacts (11), are secured to the frame, with the contacts (11) being free in translation along an axis parallel to the axis of the cylinder (3) by the intermediary of means for guiding in translation between said contacts (11) and the frame of the kiln in such a way as to follow the displacement of the annular rings (10) during the expansion/contraction of the cylinder of the kiln.

8. The device according to claim 2, wherein the annular rings (10) are rigidly secured to the cylinder of the kiln (1), and the rotating or sliding contacts (11), are secured to the frame, with the contacts (11) being free in translation along an axis parallel to the axis of the cylinder (3) by the intermediary of means for guiding in translation between said contacts (11) and the frame of the kiln in such a way as to follow the displacement of the annular rings (10) during the expansion/contraction of the cylinder of the kiln.

9. The device according to claim 3, wherein the annular rings (10) are rigidly secured to the cylinder of the kiln (1), and the rotating or sliding contacts (11), are secured to the frame, with the contacts (11) being free in translation along an axis parallel to the axis of the cylinder (3) by the intermediary of means for guiding in translation between said contacts (11) and the frame of the kiln in such a way as to follow the displacement of the annular rings (10) during the expansion/contraction of the cylinder of the kiln.

10. The device according to claim 1, wherein the ventilation means include several fans (9) supplying, in parallel, said distribution chamber (8) with cool air by the intermediary of independent circuits joining respectively each of the fans (9) to said distribution chamber (8), a valve (15) with automatic closure being associated with each of said fans (9), able to close said corresponding circuit joining said fan (9) and said distribution chamber (8) in the case of a stoppage of said fan.

11. The device according to claim 2, wherein the ventilation means include several fans (9) supplying, in parallel, said distribution chamber (8) with cool air by the intermediary of independent circuits joining respectively each of the fans (9) to said distribution chamber (8), a valve (15) with automatic closure being associated with each of said fans (9), able to close said corresponding circuit joining said fan (9) and said distribution chamber (8) in the case of a stoppage of said fan.

12. The device according to claim 4, wherein the ventilation means include several fans (9) supplying, in parallel, said distribution chamber (8) with cool air by the intermediary of independent circuits joining respectively each of the fans (9) to said distribution chamber (8), a valve (15) with automatic closure being associated with each of said fans (9), able to close said corresponding circuit joining said fan (9) and said distribution chamber (8) in the case of a stoppage of said fan.

13. The rotary kiln (1) according to claim 6, comprising said metal cylinder (3) lined internally with a refractory material (73), said cylinder (3) being rotatably mounted relative to the frame of the kiln, into which materials are intended to be inserted and fired, each of the ends of the metal cylinder (3) penetrating into a fixed case (2) wherein hot gases flow, so as to enable the continuity of the treatment circuit between the rotary kiln and the fixed portions of the installation of which the kiln is a part, the output end of the hot materials comprising a burner, being the hottest portion of the cylinder of the kiln, and wherein a sealing device (20) provides at this end the closing of the circuit of the installation between the fixed case (2) and the mobile metal cylinder (3), of the rotary kiln, by cooperating with said outer casing (6) of said device (100) for cooling the opening of a rotary kiln (1).

* * * * *